United States Patent [19]

Barpal

[11] 4,002,314

[45] Jan. 11, 1977

[54] TRAIN VEHICLE SPEED CONTROL SIGNAL PROVIDING APPARATUS

[75] Inventor: Isaac R. Barpal, McMurray, Pa.

[73] Assignee: Westinghouse Electric Corporation, Pittsburgh, Pa.

[22] Filed: July 7, 1975

[21] Appl. No.: 593,816

[52] U.S. Cl. ..... 246/63 C; 104/152; 104/153; 246/182 R; 331/56; 340/171 R

[51] Int. Cl.[2] ..... B61L 3/20

[58] Field of Search ..... 73/507; 104/152, 153; 180/105 E; 235/150.2, 150.24; 246/33, 34 R, 34 CT, 63 R, 63 C, 167 R, 182 R, 182 C, 187 R, 187 B; 307/61, 71, 233 R, 233 A, 219; 317/5; 318/563, 564; 324/79 D, 161; 328/104, 137, 154; 331/51, 56; 340/53, 62, 171 R, 171 A

[56] References Cited

UNITED STATES PATENTS

| | | | |
|---|---|---|---|
| 3,518,567 | 6/1970 | Helgesson | 328/154 X |
| 3,593,022 | 7/1971 | Hoyler et al. | 246/34 R |
| 3,748,466 | 7/1973 | Sibley et al. | 246/187 B X |

*Primary Examiner*—Stephen G. Kunin
*Attorney, Agent, or Firm*—R. G. Brodahl

[57] ABSTRACT

The present invention relates to a train vehicle speed control signal providing apparatus operative with a frequency command speed control signal, and relates to the generation of the desired speed code signals in such a frequency rate system. Two separate and independent physical and electrical operations provide each of the respective desired frequency speed code signals in combination with a comparison step to provide an output speed code signal only if the two input frequency signals are each at the desired frequency.

10 Claims, 3 Drawing Figures

TRAIN VEHICLE SPEED CONTROL SIGNAL PROVIDING APPARATUS

BACKGROUND OF THE INVENTION

It is known in the prior art to generate speed code signals to control the movement of a train vehicle, with the frequency of the provided speed control signal corresponding to a particular desired train vehicle speed of operation. For the purpose of controlling a train vehicle moving along a track including a plurality of signal blocks a series of frequency signals are needed for the respective desired train vehicle speeds, and which signals are failsafe and cannot change without detection of such change. For example, a 30 mph speed command signal cannot drift by itself to a 40 mph signal because that would be unsafe. Thusly, there is a need for generating a predetermined frequency signal for many applications, which frequency cannot change. These speed control signals may be F1 for providing a 10 mph speed for a train vehicle in a given signal block, F2 for providing a 20 mph train vehicle speed, F3 for providing a 30 mph train vehicle speed, and so forth, up to the maximum desired speed for the train vehicle.

It is known in the prior art to control the speed of a train vehicle using a master oscillator providing an output signal at a frequency of 1 megacycle, and a first associated frequency divider to provide an output signal having a frequency of 2 KHz. for controlling the speed of a train vehicle in a signal block at 10 mph, a second associated frequency divider provides an output of 3 KHz, for 20 mph train vehicle operation, a third associated frequency divider provides an output speed signal of 4 KHz. for controlling the train vehicle speed at 30 mph, a fourth associated frequency divider provides an output signal of 5 KHz. for controlling the train vehicle speed at 40 mph, and a fifth associated frequency divider provides an output signal of 6 KHz. for controlling the train vehicle speed at a maximum speed of 50 mph, and so forth. The absence of a frequency signal would be a speed command of 0 mph.

It is known to control the movement speed of a train vehicle along a track including a plurality of signal blocks through the use of speed code signals in accordance with failsafe control system operation. Attention is called to U.S. Pat. No. 3,562,712 of G. M. Thorne-Booth et al, U.S. Pat. No. 3,551,889 of C. S. Miller and U.S. Pat. Nos. 3,532,877 and re-issue 27,472 of G. M. Thorne-Booth for prior art disclosures of similar railway track signalling systems. In addition, an article entitled, "Design Techniques For Automatic Train Control" by R. C. Hoyler in the *Westinghouse Engineer* for July, 1972 at pages 98 to 104 and an article entitled "Automatic Train Control Concepts Are Implemented By Modern Equipment" by R. C. Hoyler in the *Westinghouse Engineer* for September, 1972 at pages 145 to 151 describe train control equipment designed for safe operation.

It is known in the prior art to utilize an electrical signal supply arrangement including two self-sustaining oscillator generators, either one of which is adapted to supply the output speed code signal upon failure of the other, as shown by U.S. Pat. No. 3,047,816 of Drake et al.

SUMMARY OF THE INVENTION

A plurality of failsafe frequency speed code signals F1 through Fx are provided, where $x$ is the maximum level of desired speed for the train vehicle operation, through the operation of two independent signal sources of each of the desired frequency signals. For example, a first master oscillator and an associated first frequency divider generate a control signal of frequency F1 and a different frequency second master oscillator and an associated second frequency divider independently generates a second control signal of the same frequency F1. These control signals are then utilized to control the speed of a train vehicle present within a given signal block.

DESCRIPTION OF THE PREFERRED EMBODIMENT

Figure 1:
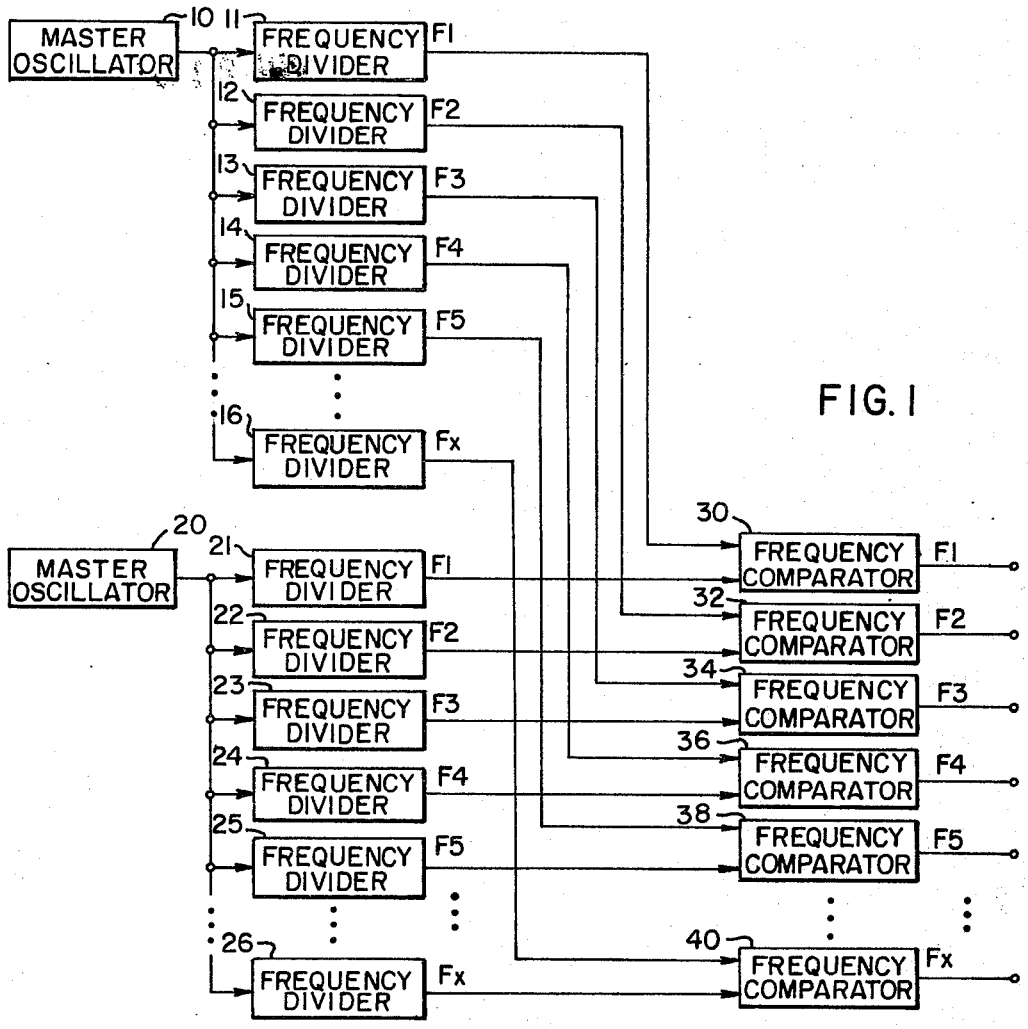
FIG. 1 is a schematic showing of the present train vehicle speed control apparatus including two independent signal sources for providing each of the desired frequency speed control signals.

As shown in FIG. 1, the present speed control signal providing apparatus 8 is shown for providing a plurality of desired speed code signals, F1 through Fx, from two independent master oscillators 10 and 20 having different frequencies, such as 1 megahertz and 7 megahertz, respectively. The output of each master oscillator is operative with associated frequency dividers having different divide ratios as necessary to obtain the desired frequency speed code signals F1 through Fx. More specifically, the master oscillator 10 providing an output signal at a first frequency, such as one megahertz, is operative with a frequency divider 11 for providing the first desired speed code signal at frequency F1, is operative with a frequency divider 12 for providing the second desired speed code signal at frequency F2, is operative with a frequency divider 13 for providing the third desired speed code signal at frequency F3, is operative with a frequency divider 14 for providing the fourth desired speed code signal at frequency F4, is operative with a frequency divider 15 for providing the fifth desired speed code signal at frequency F5, and is operative with one or more additional frequency divides, such as frequency divider 16 as required to provide any additional desired speed code signal, such as at frequency Fx, where $x$ is the maximum desired speed signal. The master oscillator 20 providing an output signal at a second frequency, such as seven megahertz, is similarly operative with a frequency divider 21 for providing the first desired speed code signal at frequency F1, is operative with the frequency divider 22 for providing the second desired speed code signal at frequency F2, is operative with the frequency divider 23 for providing the third desired speed code signal at frequency F3, is operative with the frequency divider 24 for providing the forth desired speed code signal at frequency F4, is operative with the frequency divider 25 for providing the fifth desired speed code signal at frequency F5, and is operative with one or more additional frequency dividers, such as frequency divider 26 for providing any additional speed code signal that may be desired such as at frequency Fx corresponding to the maximum desired train vehicle speed. The respective failure modes of these two independent oscillators 10 and 20 and their associated frequency dividers will be independent and different. The first speed code signal at frequency F1 from the first oscillator 10 and the frequency divider 11 is then compared in a frequency comparator 30 with the first speed code signal at frequency F1 from the second master oscillator 20 and the frequency divider 21, which comparison can be done by the frequency comparator 30, which could provide an analog conversion operation and then comparing the magnitudes of the two analog signals in an integrated circuit voltage comparator or the two speed signal frequencies F1 can be mixed and passed through a narrow bandpass filter, which comparator operations are per se well known to persons skilled in this art. The output of the frequency comparator 30 is the first desired speed code signal at frequency F1, representative of a desired train vehicle speed, and since the speed code signal at frequency F1 cannot be permitted to change for reasons of train vehicle operational safety, the output from the frequency comparator 30 is the first desired speed code signal at frequency F1, or when the signal from the frequency divider 11 does not compare in frequency with the signal from the frequency divider 21, there is no output speed signal provided by the frequency comparator 30.

A suitable frequency comparator for this purpose is disclosed in copending U.s. patent application Ser. No. 545,231, filed Jan. 29, 1975 by L. W. Anderson and D. H. Woods and entitled "Train Vehicle Protection Apparatus Including Signal Block Occupancy Determination".

The frequency comparator 32 is operative to compare the frequency F2 of the speed code signal from the frequency divider 12 with the frequency F2 of the speed code signal from the frequency divider 22 and to provide an output signal at frequency F2 when these respective signals are of the same frequency. The frequency comparator 34 is operative to compare the speed control signal from the frequency divider 13 with the speed control signal from the frequency divider 23 and to provide an output signal at frequency F3 when these respective signal frequencies are the same. The frequency comparator 36 is operative to compare the speed code signal from the frequency divider 14 with the speed code signal F4 from the frequency divider 24 and to provide an output signal at frequency F4 when these respective signal frequencies are the same. The frequency comparator 38 is operative to compare the speed code signal from the frequency divider 15 with the speed code signal from the frequency divider 25 and to provide an output signal at frequency F5 when these respective signal frequencies are the same. One or more additional frequency comparators are provided as required for the number of speed conrol signals desired, such as the frequency comparator 40, which is operative to compare the speed code signal from the frequency divider 16 with the speed code signal from the frequency divider 26 and to provide an output signal at frequency Fx when these respective signals are the same.

Figure 2:
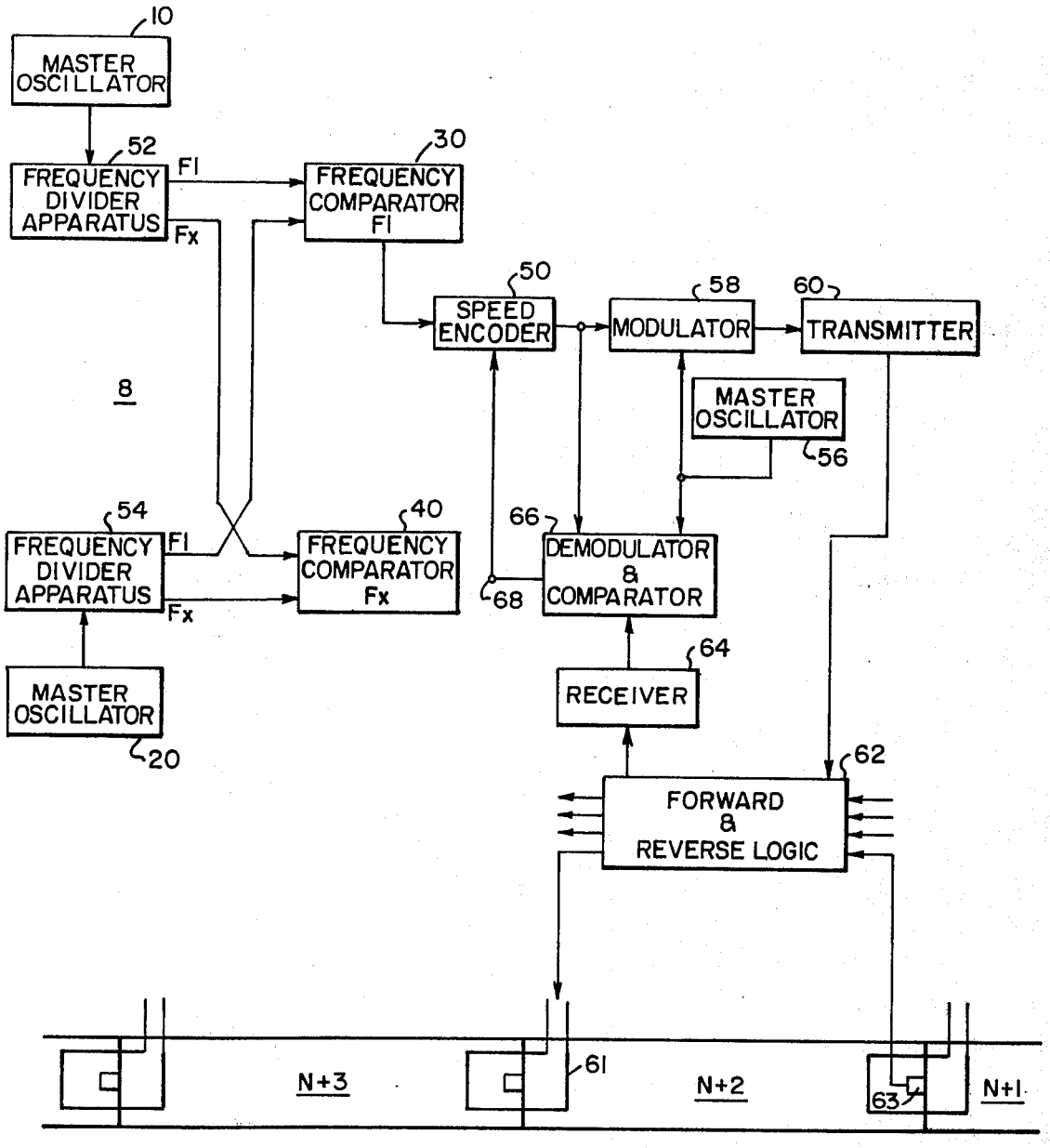
FIG. 2 illustrates an application of the present control apparatus for supplying speed control signals to a track circuit signal block.

As shown in FIG. 2, a train vehicle speed control system such as presently operative with the N.Y. Transit Authority is generally shown to illustrate a practical train vehicle speed control apparatus embodiment including the present speed control signal apparatus.

One of the speed control signals, for example, the first desired speed control signals at frequency F1, is supplied to the speed encoder 50 for a track circuit signal block such as signal block N+2, which encoder can include well known speed signal frequency selection circuits. The speed code signal then amplitude modulates a master carrier signal from the master oscillator 56 in the modulator 58, which carrier on the track may be at a frequency of 990 Hz. and with the speed code signals F1 through Fx being in the range of frequency between 5 Hz. to 20 Hz. The speed code signal modulated carrier is supplied by the modulator 58 to the transmitter 60 for the signal block N+2 for controlling the speed of a train vehicle present within that signal block N+2. The 990 Hz. carrier with the speed modulation rate is used aboard the train vehicle for controlling the speed of the propulsion motors operative with the train vehicle. From the modulator 58 the carrier signal goes through the transmitter 60 to a signal block such as signal block N+2 and if a train vehicle were present within that signal block N+2, that train vehicle will respond to the speed code signal and operate at the desired speed. The forward/reverse logic device 62 can be provided to turn around the relationship of the transmitter and receiver as required for running the train vehicles in a forward or a reverse direction, as may be desired. The transmitted speed code signal goes out to the antenna 61 operative with the track circuit signal block N+2, and the received signal comes back from antenna 63 into the receiver 64. The received signal is supplied to a demodulator and comparator 66 where the signal is demodulated and compared with the earlier transmitted signal. The same carrier frequency signal from the master oscillator 56 is supplied to the comparator 66 for this purpose, and this runs a commutating filter to provide an ENABLE signal at output 68. The ENABLE signal is an output signal indicating that there is no train vehicle occupancy in the involved signal block N+2, and it is operative to enable the next previous signal block speed encoder which would be the speed encoder for the signal block N+1.

On the other hand, in some train control systems, the 990 Hz. signal is not transmitted to a given signal block until the train enters that signal block, so the ENABLE signal provided at terminal 68 could be applied to enable the speed encoder for the same signal block N+2 if desired for that situation.

The BART system pulbications above-cited illustrate another prior art train control system operation in which the present invention could be applied.

The different frequencies provided by the two master oscillators 10 and 20, and the respective different divider rates as shown in FIG. 1 make the present train vehicle speed control apparatus design failsafe in operation. Industry standards today accept that redundancy with different failure modes will result in failsafe train vehicle control operation. Train vehicle speed control apparatus operation cannot reasonably be made totally failsafe, but in reality it is a matter of acceptable and reasonable degree. At the present time, it is generally accepted that the provision of different master oscillator frequencies and different divide rates, as shown in FIG. 1, is substantially failsafe in operation.

Figure 3:
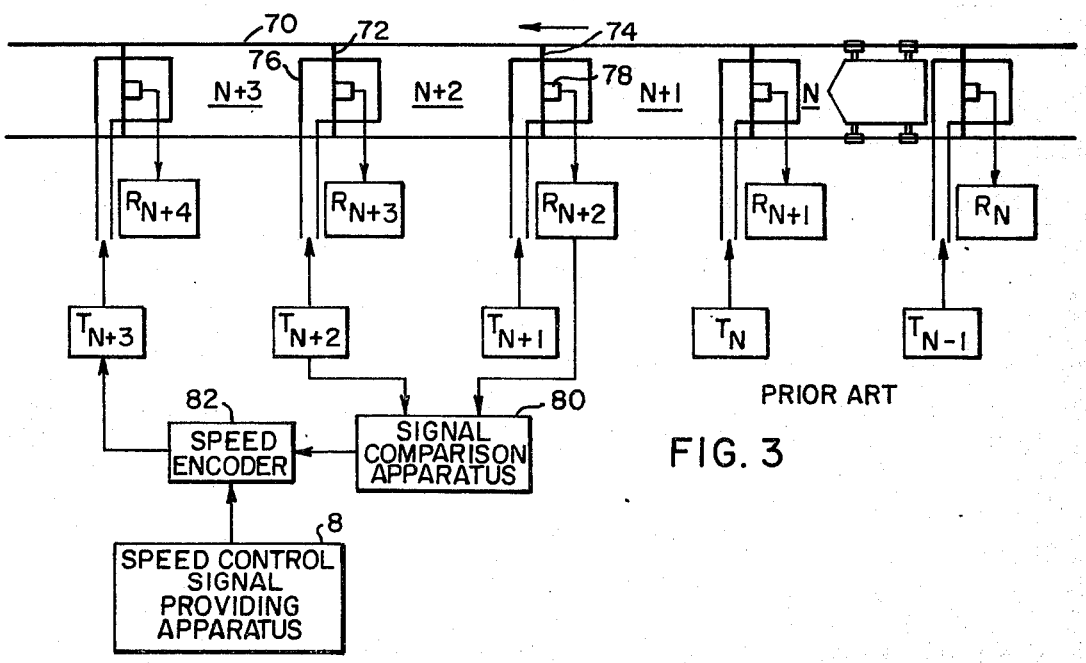
PRIOR ART FIG. 3
FIG. 3 illustrates the prior art track circuit signal blockk arrangement to which the present train vehicle speed control apparatus could be applied.

In FIG. 3, there is illustrated another prior art track circuit signal block arrangement in which the present rain vehicle speed control signal providing apparatus 8 could be applied. A track 70, including a plurality of signal blocks N, N+1, N+2 and N+3 are shown in FIG. 3. The signal blocks are defined by low impedance connector bars 72 and 74, as shown in relation to signal block N+2. A transmitter $T_{N+2}$ is operative with antenna 76 for introducing into the signal block N+2 the speed control signal and an antenna 78 operative with the signal block N+2 receives that speed code signal and supplies it to receiver $R_{N+2}$. When a train vehicle is present within the signal block N+2, the short circuit impedance of the wheels of the train vehicle are operative to prevent the receiver $R_{N+2}$ from receiving the speed code signal transmitted by the transmitter $T_{N+2}$. The signal received by the receiver $R_{N+2}$ and the signal transmitted by the transmitter $T_{N+2}$ are supplied to a signal comparison apparatus 80, such that if the receiver $R_{N+2}$ is receiving the speed code signal transmitted by the transmitter $T_{N+2}$, this indicates there is no train vehicle present within the signal block N+2, and the signal comparison apparatus will provide an ENABLE signal to the speed encoder 82 operative with the transmitter $T_{N+3}$ for the next succeeding and adjacent signal block N+3, as well known to persons skilled in this art. The speed encoder 82 could be similar to the speed encoder 50 shown in FIG. 2, if desired.

What I claim is:

1. In a train vehicle control apparatus for determining the operation of a train vehicle along a track including a plurality of signal blocks, the combination of:

means for providing a first frequency signal having one predetermined frequency for controlling the operation of said train vehicle, means responsive to said first frequency signal for providing a first output signal, means for providing a second frequency signal having a different predetermined frequency for controlling the operation of said train vehicle, means responsive to said second frequency signal for providing a second output signal, and means for comparing the respective frequencies of said first output signal and said second output signal for providing a control signal for controlling the operation of said train vehicle when the respective frequencies of said first output signal and said second output signal are substantially the same.

2. The train vehicle control apparatus of claim 1, including means responsive to said control signal for controlling the operation of said train vehicle in one of said signal blocks.

3. The train vehicle control apparatus of claim 1, with said first frequency signal having one predetermined frequency in accordance with the desired speed operation for said train vehicle and with said second frequency signal having a different predetermined frequency in accordance with the same desired speed operation for said train vehicle.

4. The train control apparatus of claim 1, with said control signal having a predetermined frequency in accordance with a desired speed of operation for said train vehicle.

5. The train vehicle control apparatus of claim 1, including means operative with one of said signal blocks and responsive to said control signal for controlling the speed of operation of said train vehicle in said one signal block.

6. In speed control signal providing apparatus for determining the speed of operation of a train vehicle along a track including a plurality of signal blocks, the combination of means for providing a first output signal having one predetermined frequency, means for modifying said first output signal to provide at least a first speed control signal having a frequency in accordance with a desired speed of operation for said train vehicle, means for providing a second output signal having a different predetermined frequency, means for modifying said second output signal to provide at least a second speed control signal having a frequency in accordance with said desired speed, and means for comparing said first speed control signal and said second speed control signal in relation to frequency.

7. The speed control signal providing apparatus of claim 6, including means operative with said comparing means for controlling the speed of operation of said train vehicle in one of said signal blocks.

8. The speed control signal providing apparatus of claim 6, with the frequency of said first speed control signal being substantially the same as the frequency of said second speed control signal.

9. The speed control signal providing apparatus of claim 6, with said means for modifying said first signal output signal including a plurality of frequency dividers, and with said means for modifying said second output signal including a plurality of frequency dividers.

10. The speed control signal providing apparatus of claim 6, with said comparing means including means operative to control said train vehicle in one of said signal blocks.

* * * * *